United States Patent [19]

Tone

[11] Patent Number: 4,945,795

[45] **Date of Patent: * Aug. 7, 1990**

[54] APPARATUS FOR CONTINUOUSLY CUTTING SOFT MATERIAL SUBJECT TO ELONGATION BY TENSILE FORCE

[75] Inventor: Hideo Tone, Saitama, Japan

[73] Assignee: Kokusan Kogyo Kabushiki Kaisha, Saitama, Japan

[ * ] Notice: The portion of the term of this patent subsequent to Apr. 3, 2007 has been disclaimed.

[21] Appl. No.: 248,812

[22] Filed: Sep. 23, 1988

[30] Foreign Application Priority Data

Sep. 26, 1987 [JP] Japan ..... 62-242348

[51] Int. Cl.[5] ..... B26D 3/00

[52] U.S. Cl. ..... 83/27; 83/49; 83/100; 83/102; 83/402; 83/650

[58] Field of Search ..... 83/24, 27, 39, 40, 49, 83/52, 214, 277, 620, 621, 100, 102, 107, 402, 650, 272, 44, 45, 46, 47; 242/67.1 R

[56] References Cited

U.S. PATENT DOCUMENTS

| | | | |
|---|---|---|---|
| 1,914,293 | 6/1933 | Reynolds | 83/272 X |
| 3,088,353 | 5/1963 | Hanington | 83/24 |
| 3,802,307 | 4/1974 | Oggoian | 83/27 X |
| 3,991,926 | 11/1976 | Marks | 83/650 X |
| 4,082,261 | 4/1978 | Johannisson et al. | 83/277 X |
| 4,315,794 | 2/1982 | Palmieri | 83/100 X |
| 4,344,342 | 8/1982 | Garvin | 83/45 |
| 4,773,293 | 9/1988 | Mizuta et al. | 83/39 |

*Primary Examiner*—Douglas D. Watts
*Assistant Examiner*—Eugenia A. Jones
*Attorney, Agent, or Firm*—Flynn, Thiel, Boutell & Tanis

[57] ABSTRACT

An apparatus for cutting soft sheetlike material, such as a fabric material, which is subject to elongation due to effect of tensile force. The apparatus has a driving device for supplying a layered severable material in an intermittent step-like manner from an upper position to a lower position. A cutting device cooperates with the layered severable material, when in a stationary vertically-suspended condition, for forming cutting lines of basic configuration therein along the elongate direction thereof, with such cutting lines being repeatedly formed following each advancing step of the material to create cutting lines which extend substantially continuously along the severable material. Devices are also provided for removing non-wanted portions of the severable material so as to leave only the essential portion. The severable material includes, superimposed sheets of flexible soft material and thin flexible backing, which sheets are separated and independently wound following the cutting step.

8 Claims, 3 Drawing Sheets

APPARATUS FOR CONTINUOUSLY CUTTING SOFT MATERIAL SUBJECT TO ELONGATION BY TENSILE FORCE

CROSS REFERENCE TO RELATED APPLICATION

This application is related to my copending application Ser. No. 07/248,810, filed concurrently herewith, and entitled "SOFT MATERIAL CUTTING APPARATUS". The disclosure of this latter application is, in its entirety, incorporated herein by reference.

FIELD OF THE INVENTION

The present invention relates to an apparatus for continuously cutting soft material which is subject to elongation due to the effect of tensile force. More particularly, it relates to an apparatus for continuously cutting soft fabriclike material which is subject to elongation by effect of tensile force without causing the soft material to incur elongation, severance, distortion, and slack by effect of tensile force while processing is underway.

BACKGROUND OF THE INVENTION

A variety of electronic computers are available for processing information and various data. Conventionally these computers use floppy discs as a media for external memory storage. Each floppy disc is made from a flexible magnetic disc which is sealed inside of a jacket or liner. The liner is normally made from soft sheetlike material such as a non-woven fabric. The liner protects the floppy magnetic disc from dust and, at the same time, provides the disc with an adequate amount of rotation torque.

The soft material which makes up liner is inherently subject to elongation from the effect of tensile force. When producing liners by continuously cutting soft material which is subject to elongation due to the effect of tensile force, extreme care should be exercised to prevent the liner from incurring elongation, severance, and distortion caused by such tensile force. To prevent this, conventionally a cutting line of the basic pattern is sequentially and individually formed, either from above or from below, on the surface of soft material as it is conveyed in a horizontal direction, followed by removal of useless portions until only the essential portion remain for eventually making up the liner.

Nevertheless, when cutting soft material which is subject to elongation due to the effect of tensile force while conveying it in the horizontal direction, the cutting operation may be executed against the soft material which is already elongated by tensile force. Elongation causes the above soft material to incur distortion and slack, thus eventually causing the essential portion to deform itself via the cutting operation. Since any of these conventional liner processing systems sequentially and individually form cutting lines of a basic pattern and then remove useless portions from the processed material, production of liners on a continuous basis cannot be properly executed.

An object of this invention is to overcome the problems mentioned above by providing an apparatus capable of continuously cutting off soft material which is subject to elongation due to the effect of tensile force without causing the material to incur elongation, severance, distortion, and slack, throughout the entire processing operations.

To achieve the above object, the invention provides an apparatus for continuously cutting soft material subject to elongation due to the effect of tensile force, which apparatus is provided with the following: means for supplying a layered severable member from an upper position to a lower position, in which the severable member is superimposedly composed of a thin sheetlike flexible soft material which is subject to elongation due to the effect of tensile force and a thin sheetlike flexible solid base material which inhibits elongation of the soft material due to said tensile force; means for forming continuous cutting lines of basic configuration on a surface of the severable member delivered from the upper position to the lower position; means for removing only useless portions from the severable member so as to leave only the essential portion; and means for independently winding the soft material and the solid base material after separating them from the useless portions.

The inventive apparatus sequentially executes the above operations including the following: supplying the severable member which is superimposedly composed of soft material and solid base material from the upper position to the lower position; repeatedly forming cutting lines of basic pattern on the surface of the supplied severable member thereafter removing only the useless portions from the severable member so as to leave only the essential portion; and separating the soft material and the solid base material from each other and independently winding them.

By implementing these sequential operations, the apparatus related to the invention can continuously cut off soft material which is subject to elongation by effect of tensile force without causing it to incur elongation, severance, distortion, and slack which would otherwise be caused due to the effect of tensile force.

DETAILED DESCRIPTION

Figure 1:
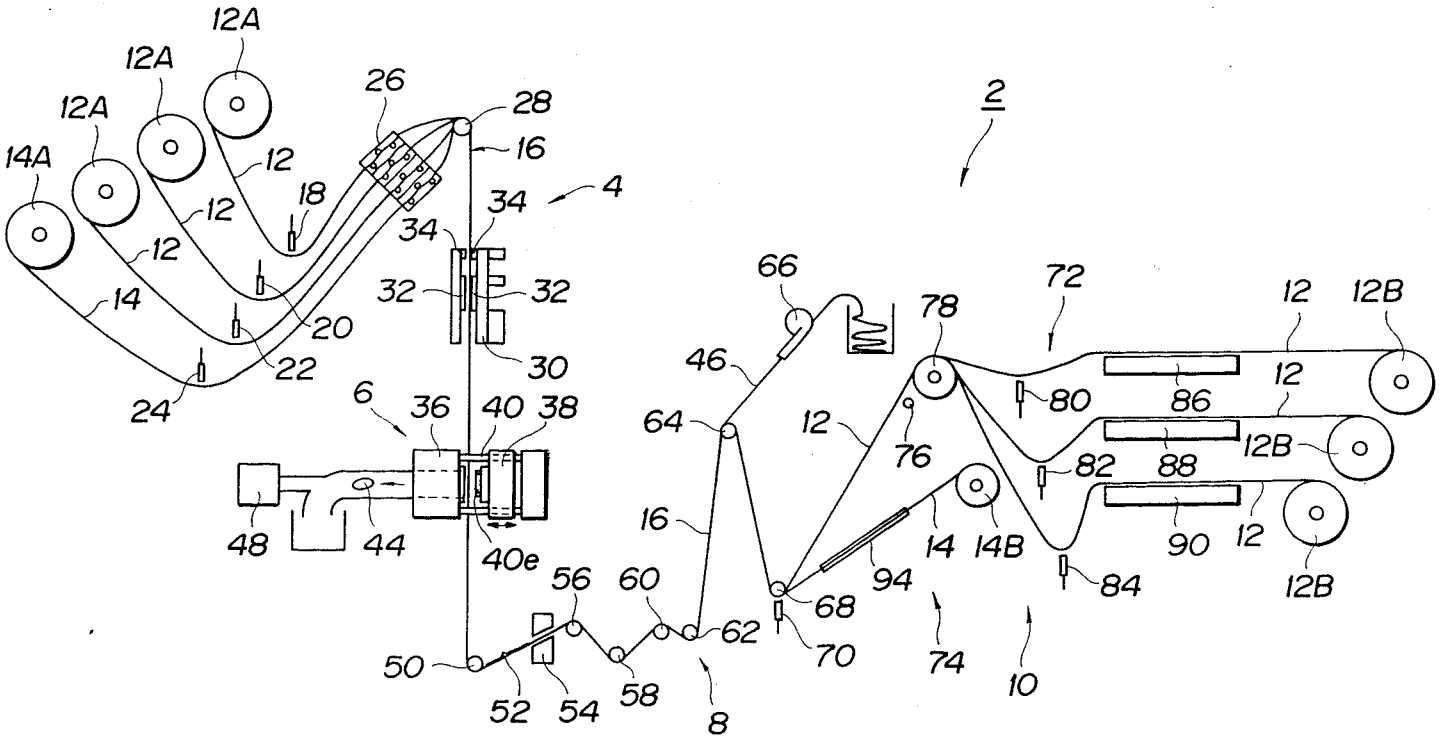
FIG. 1 is the simplified schematic diagram of a continuous material cutting apparatus according to the invention.
Figure 2:
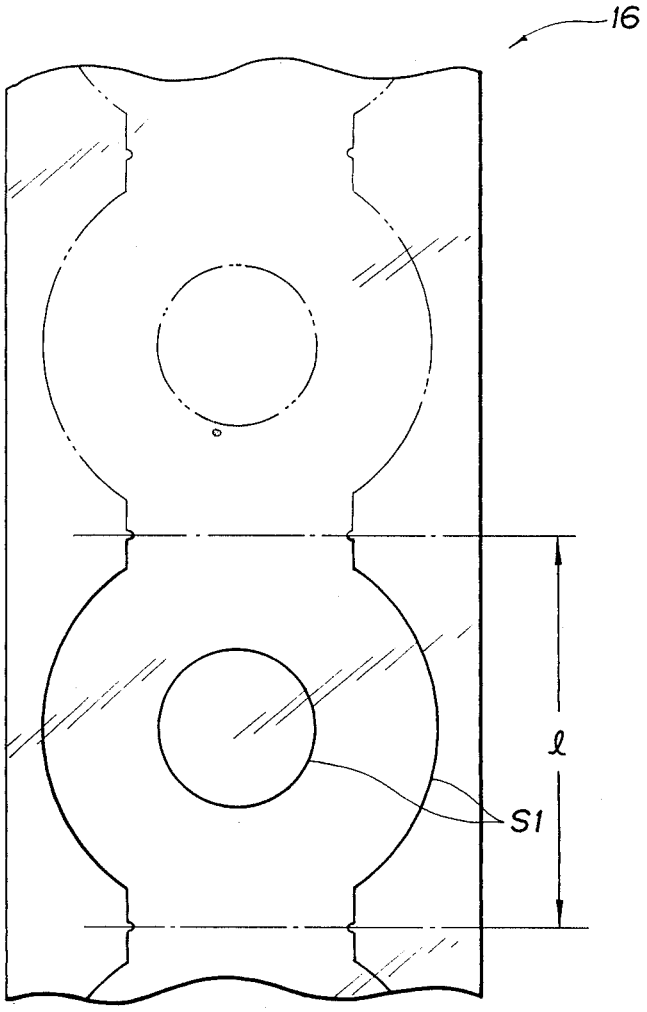
FIGS. 2 and 3 are respectively the plans denoting the severable member embodied by the invention.
Figure 3:
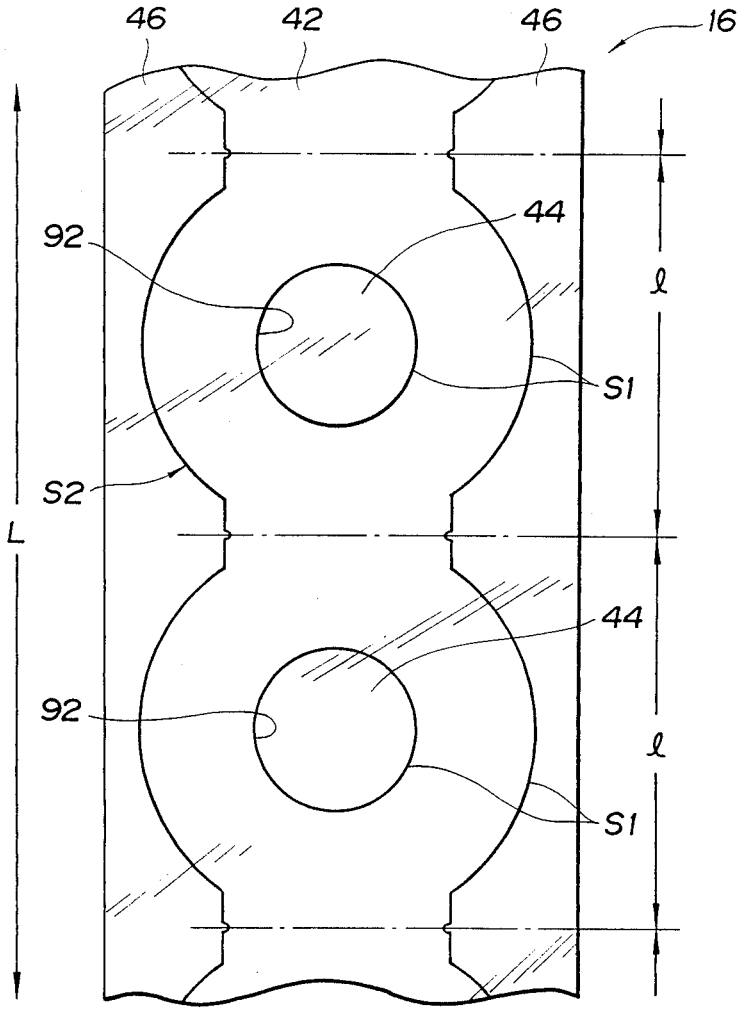

FIGS. 1 through 3 respectively denote a preferred embodiment of the invention. First, referring to FIG. 1, the apparatus 2 for continuously cutting a thin, flexible, elongate soft-material fabric is provided with means 4 for supplying a severable member, means 6 for continuously forming cutting lines, means 8 for removing useless portions, and means 10 for winding up the severable member.

Means 4 vertically feeds a severable member 16 in a downward direction. This member 16 is formed of superimposed layers including at least one layer, or primary member, of soft-material fabric 12, such as a non-woven fabric which elongates in the presence of tensile force, and at least one layer, or base member of solid non-extendable base material 14 (such as a thin flexible kraft paper) which inhibits elongation of soft-material fabric 12 due to tensile force. Means 4 for supplying severable member 16 is substantially composed of the following: one or more rollers 12A respectively winding original soft-material fabrics 12; one or more rollers 14A respectively winding original solid base material 14; a plurality of sensors 18 through 24 which respectively detect a slack condition of soft-material fabrics 12 and solid base material 14 as unwound from rollers 12A and 14A; a tension generator 26 which provides each piece of soft-material fabrics 12 and solid base material 14 with a specific amount of tension; a first roller 28 which feeds the severable member 16 so that the layers thereof are properly arranged in a row by the effect of adequate tension as received from tension generator 26; and an air-feeder 30 which feeds the severable member 16 from an upper position to a lower position in a step-like manner by applying air pressure. The air-feeder 30 is substantially composed of (1) a reciprocating conveying device 32 which moves itself in the vertical direction to feed the severable member 16 from the upper position to the lower position at a specific interval by grasping the severable member 16 during the descending movement and (2) a material retaining device 34 which prevents the severable member 16 from freely moving itself while the conveying device 32 ascends. The air-feeder 30 orients the direction for supplying the severable member 16 in the descending direction within specific angles including perpendicularity.

Means 6 repeatedly forms cutting lines S1 of the basic pattern covering the predetermined length l (shown in FIG. 2) on the surface of the severable member 16 which is conveyed from the upper position to the lower position at a specific interval by the conveying device 32 of the supply means 4 so that edge portions can continuously be reproduced for eventually shaping the required continuous cutting lines S2 covering the entire length L of the severable member 16 as shown in FIG. 3.

Means 6 for continuously forming cutting lines on the severable member 16 is substantially composed of (1) driver unit 36, (2) operation unit 38 which is mounted to the driver unit 36 so that it can reciprocate itself to the left and to the right synchronous with the vertical movement of the conveying device 32 of the air-feeder 30, and (3) blade unit 40 which is mounted to the operation unit 38 and provided with blade 40*e* for forming the cutting line S1 of the basic pattern.

Means 8 removes useless circular portion 44 from the center and useless irregular side portions 46 from both sides of the essential portion 42 shown in FIG. 3, leaving only the essential portion 42 which is provided with the cutting line S2 satisfying the required configuration. Means 8 is substantially composed of the following: (1) air-suction system 48 which interconnects with the driver unit 36 of means 6 for forming cutting lines, where the driver unit 36 blows air against the useless circular portion 44 in the center of the severable member 16 to cause the useless circular portion 44 to be removed while forming the cutting line S1 of the basic pattern: (2) the second roller 50 which deflects the severable member 16 having the cutting line S2 matching the required configuration; (3) a separation rod 52 which separates the essential portion 42 from the useless irregular portions 46 as present on both sides of the severable member 16; (4) static-electricity removal system 54 which discharges static electricity from the severable member 16 and sucks air for removing the useless circular portion 44 from the center of the severable member 16; (5) the third through seventh rollers 56 through 64 which respectively provide an adequate amount of tension for the severable member 16 which primarily comprises only the essential portion 42; and (6) an air-suction system 66 which sucks air for removing the useless irregular portions 46 from both sides of the essential portion 42 as separated by means of the separation rod 52.

Means 10 separately wind up the soft-material fabric 12 and solid base material 14, which superimposedly make up the severable member 16, after they are respectively disengaged from useless portions 44 and 46 by operation of means 8 mentioned above. Means 10 for winding severable member 16 is substantially composed of (1) slack sensor 70 which is installed in a position close to the eighth roller 68 for detecting the slack condition of the severable member 16, (2) a soft-material fabric winding system 72, and (3) a solid base material winding system 74.

Soft-material fabric winding system 72 is substantially composed of the following: (1) static-electricity discharger 76 which discharges static electricity from the soft-material fabrics 12 separated from solid base material 14 at the eighth roller 68; (2) slack sensors 80 through 84 which respectively detect a slack condition of each of the soft-material fabrics 12 as separated at the ninth roller 78; (3) guide sensors 86 through 90 which respectively detect the posture of each piece of soft-material fabric, such as detecting distortion and the presence of dust, and checking to see if any of the useless circular portions 44 still adhere to the essential portion 42; and (4) a plurality of soft-material fabric takeup rollers 12B which are respectively driven by detection signals from the slack/guide sensors 80 through 90. Each of these takeup rollers 12B is rotated only when slack sensors 80 through 84 detect the presence of slack in soft-material fabric 12. Conversely, rotation of these takeup rollers 12B is stopped when no slack is detected. Furthermore, rotation of these takeup rollers 12B is stopped if guide sensors 86 through 90 detect that any of these soft-material fabrics 12 is distorted.

Solid base material winding system 74 is substantially composed of the following: (1) a pitch sensor 94 which detects the clearance of hole 92 in the solid base material as it is separated from the soft-material fabric 12 by the eighth roller 68; and (2) the solid base material takeup roller 14B which is driven by a detection signal from slack sensor 70 which is positioned close to the eighth roller 68 and also by detection signal from pitch sensor 94. The solid base material takeup roller 14B is rotated only when slack sensor 70 detects the presence of slack in the severable member 16, whereas rotation of this roller is stopped when no slack is detected. In addition, rotation of this takeup roller 14B stops when pitch sensor 94 detects abnormal clearance of hole 92 caused by distortion of the solid base material 14.

OPERATION

To properly process soft material, which is subject to elongation due to tensile force, into continuous liner for floppy disc, for example by cutting it with the continuous cutting apparatus 2, first the severable-member supply means 4 feeds severable member 16. Depending on the slack condition detected by slack sensors 18 through 24, supply means 4 first winds soft-material fabric 12 and solid base material 14 from a plurality of soft-material rollers 12A and a base material roller 14A for example. Then, these web materials are respectively straightened by means of tensile force generated by tension generator 26. The first roller 28 then superimposes the layers of soft-material fabric 12 and solid base material 14 so that a superimposed web of severable member 16 is constituted. The prepared severable member 16 is then vertically conveyed in the descending direction by the air-feeder 30. By operating the conveying device 32, air-feeder 30 vertically conveys the severable member 16 downward in an intermittent steplike manner. While the conveying device 32 ascends, retaining device 34 holds the severable member 16 to inhibit its movement. The air-feeder 30 orients the direction for supplying the severable member 16 in a descending direction within specific angles including perpendicularity.

Since the cutting apparatus related to the invention vertically feeds the severable member 16 formed by superimposed layers including soft-material fabric 12 subject to elongation by tensile force and solid base material 14 inhibiting such elongation, the inventive apparatus securely prevents the soft-material fabric 12 from incurring elongation, severance, and distortion due to the effect of tensile force.

Next, operation unit 38 (which is mounted to the driver unit 36 of cutting-line forming means 6 and movable to the left and to the right) is activated so that it can perform reciprocating movement in the horizontal direction synchronous with the vertical reciprocating operation of conveying device 32. This allows blade 40e of blade unit 40 to repeatedly form cutting lines S1 of the basic configuration covering a specific length l as shown in FIG. 2 on the severable member 16 during the intervals when the member 16 is stationary. As a result, edge portion can continuously be reproduced by eventually generating continuous cutting lines S2 of the required pattern covering the entire length L of the severable member 16 as shown in FIG. 3.

After forming the cutting lines S2 of the required pattern by operating cutting-line forming means 6, the useless center circular portions 44 and the useless irregular side portions 46 are respectively removed from the severable member 16 by useless-portion removal means 8, leaving only the essential portion 42.

When cutting-line forming means 6 forms cutting line S1 matching the basic pattern, air-suction system 48 as mounted to the main body 36 of cutting-line forming means 6 blows air against useless center circular portion 44 and then sucks it for eventually removing it. The severable member 16 is then wound onto the second roller 50, and then, separation rod 52 splits the severable member 16 into the essential portion 42 (as defined between the side cutting lines S2) and the useless irregular side portions 46 which are present on both sides of the essential portion 42.

If any of the useless circular portions 44 still adhere to the center of the severable member 16, even after blowing air against them by means of air-suction system 48, then the static-electricity discharging system 54 discharges static electricity from the severable member 16 and then sucks air therethrough so that the remaining useless circular portions 44 can be removed.

Then, the severable member 16, freed from the useless circular portion 44 and useless irregular side portions 46, receives a specific amount of tensile force from the third through seventh rollers 56 through 64. On the other hand, the useless irregular side portions 46 are removed from both sides of the severable member 16 by means of an air-sucking operation executed by the air-suction system 66.

The remaining severable member 16, which is free of the useless circular portion 44 and useless irregular side portions 46, is then conveyed to severable-member winding means 10, which then separately winds the layers of soft-material fabric 12 and solid base material 14 onto separate takeup rollers 12B and 14B, respectively.

Soft-material winding system 72 winds only soft-material fabric 12. Concretely, the layers of superimposed soft-material fabrics 12 are separated from the solid base material 14 at the eighth roller 68 and travel themselves past static-electricity removal system 76, which then discharges static electricity from the superimposed soft-material fabrics 12 so that the layers of superimposed fabrics 12 can be easily separated from each other. These soft fabrics 12 then pass over the ninth roller 78, and then these soft fabrics are separated from each other. Each of these soft-material fabrics is then checked by respective slack sensors 80 through 84 and respective guide sensors 86 through 90 which respectively generate signals for detecting the presence or absence of slack, distortion, dust, and also the presence of the useless circular portions 44 if they remain. Finally, each of these soft-material fabrics 12 is separately wound onto one of the rotating takeup rollers 12B.

On the other hand, solid base material 14 is wound onto the base material winding system 74. Concretely, solid base material 14 as separated from the soft-material fabric 12 at the eight roller 68 is wound onto the base material takeup roller 14B which is driven by detection signals from a slack sensor 70 installed at a position close to the eighth roller 68 and a pitch sensor 94 which detects clearance of hole 92 so as to determine proper removal of the useless circular portion 44 of the solid base material 14. As mentioned above, superimposed severable member 16 which is separated from the useless portions 44 and 46, leaving only the essential portion 42, is split into layers of soft-material fabrics 12 and solid base material 14 before both of these are eventually wound onto takeup rollers 12B and 14B. Each of the soft-material fabrics is continuously cut and wound onto takeup rollers 12B and is eventually delivered to an ensuing process. For example, soft-material fabric 12 is then cut off at a specific length l and provided with holes for eventually being processed into liners for floppy discs.

The preferred embodiment of the inventive cutting apparatus first prepares the severable member 16 by superimposing soft-material fabric 12 and solid base material 14 which inhibits elongation of the soft-material fabric 12 due to tensile force. The apparatus then vertically feeds the superimposed severable member 16 in the downward direction in a steplike manner, and then, repeatedly forms cutting lines S1 matching the surface of the severable member 16. The apparatus then removes useless portions 44 and 46 from the severable member 16, leaving only the essential portion 42, and finally it winds soft-material fabric 12 and solid base material 14 discretely onto separate takeup rollers 12B and 14B. As a result, the apparatus continuously and stably cut only the essential portion 42 out of soft-material fabric 12 without causing it to incur severance, distortion, and slack from the effect of tensile force.

Although the above preferred embodiment has merely referred to the liner of a floppy disc as the object of applying soft-material fabric 12 which is subject to elongation by effect of tensile force, the applicability of the soft-material fabric 12 related to the invention is not merely confined to the liner of a floppy disc, but it is also applicable to the production of gaskets or other products such as cushions.

The embodiments of the invention in which an exclusive property or privilege is claimed are defined as follows:

1. An apparatus for continuously cutting material which is subject to elongation by tensile force, comprising:

means for supplying a flexible, elongate and substantially continuously sheetlike primary member made of a soft material which is subject to elongation by tensile force applied thereto;

means for supplying a flexible, elongate and substantially continuously sheetlike base member substantially more resistant to elongation by tensile force applied thereto than said primary member;

means for longitudinally superimposing said elongate primary member and said elongate base member to form a flexible elongate and substantially continuously sheetlike severable member, said severable member being substantially more resistant to elongation by tensile force applied thereto than said primary member;

means for forming continuous cutting lines on said severable member, including means for cutting said severable member, means for periodically feeding a predetermined amount of said severable member from a first position above said cutting means downward to a second position opposing said cutting means, and means operable synchronously with said feeding means for periodically moving said cutting means into and out of engagement with said severable member such that said cutting means repeatedly forms cuts on said severable member, each of said continuous cutting lines being formed by a plurality of said repeatedly formed cuts, said cuts having a predetermined substantially curved configuration, said continuous cutting lines having a substantially curved repeating configuration defined by repeating said predetermined substantially curved configuration of said cuts, said continuous cutting lines extending longitudinally on said elongate severable member for substantially the entire length thereof, said continuous cutting lines dividing said severable member, including said primary member and base member as components thereof, into an essential portion and a waste portion;

means for removing said waste portion from said severable member so as to leave only said essential portion; and means for separating and then separately winding said essential portion of said primary member and said essential portion of said base member.

2. The apparatus according to claim 1, wherein said primary member is made from a thin non-woven fabric, and wherein said base member is a think kraft paper.

3. The apparatus according to claim 2, wherein said feeding means includes means directly engagable with said severable member for directly gripping said severable member, said gripping means being movable upwardly and downwardly.

4. The apparatus according to claim 3, wherein said gripping means grips and moves said severable member downwardly during downward movement of said gripping means, and wherein said feeding means includes retaining means for preventing upward motion of the severable member while said gripping means moves upwardly.

5. The apparatus according to claim 1, wherein said primary member includes plural sheetlike layers of said soft material.

6. A method for forming continuously extending cutting lines on material which is subject to elongation by tensile force, comprising the steps of:

providing a flexible, elongate and substantially continuously sheetlike primary member made of a soft material which is subject to elongation by tensile force applied thereto;

providing a flexible, elongate and substantially continuously sheetlike base member which is substantially more resistant to elongation by tensile force applied thereto than said primary member;

then longitudinally superimposing said elongate primary member and said elongate base member to form a flexible, elongate and substantially continuously sheetlike severable member which is substantially more resistant to elongation by tensile force applied thereto than said primary member;

positioning said severable member such that it extends vertically alongside a horizontally movable cutting device so as to oppose said cutting device;

cutting said severable member with said cutting device so as to form thereon continuously extending cutting lines which divide said severable member, including said primary member and base member as components thereof, into an essential portion and a waste portion;

removing said waste portion from said severable member so as to leave only said essential portion; and separating and then separately winding said essential portion of said primary member and said essential portion of said base member.

7. The method according to claim 6, wherein said step of cutting said severable member to form continuously extending cutting lines thereon includes the steps of vertically feeding said severable member in an intermittent steplike manner such that successively adjacent portions of said severable member, which portions have a predetermined length, sequentially oppose said cutting device, and using said cutting device to form cuts of predetermined configuration on said successively adjacent predetermined length portions of said severable member.

8. The method according to claim 7, wherein said continuously extending cutting lines extend longitudinally for substantially the entire length of said elongate severable member.

* * * * *

UNITED STATES PATENT AND TRADEMARK OFFICE

CERTIFICATE OF CORRECTION

PATENT NO. : 4,945,795

DATED : August 7, 1990

INVENTOR(S) : Hideo TONE

It is certified that error appears in the above-identified patent and that said Letters Patent is hereby corrected as shown below:

Column 7, line 57; change "think" to ---thin---.

Signed and Sealed this

Third Day of March, 1992

*Attest:*

HARRY F. MANBECK, JR.

*Attesting Officer*

*Commissioner of Patents and Trademarks*